US008991348B2

(12) United States Patent
Kawai et al.

(10) Patent No.: US 8,991,348 B2
(45) Date of Patent: Mar. 31, 2015

(54) VALVE TIMING CONTROL APPARATUS

(71) Applicant: Aisin Seiki Kabushiki Kaisha, Kariya-shi (JP)

(72) Inventors: Yoshiyuki Kawai, Nagoya (JP); Shohei Masuda, Anjo (JP); Masaki Kobayashi, Okazaki (JP); Kazuo Ueda, Gamagori (JP); Hideomi Iyanaga, Chiryu (JP)

(73) Assignee: Aisin Seiki Kabushiki Kaisha, Kariya-shi, Aichi-Ken (JP)

( * ) Notice: Subject to any disclaimer, the term of this patent is extended or adjusted under 35 U.S.C. 154(b) by 0 days.

(21) Appl. No.: 14/203,116

(22) Filed: Mar. 10, 2014

(65) Prior Publication Data

US 2014/0251245 A1 Sep. 11, 2014

(30) Foreign Application Priority Data

Mar. 11, 2013 (JP) ..... 2013-048415
Jan. 28, 2014 (JP) ..... 2014-013518

(51) Int. Cl.
*F01L 1/34* (2006.01)
*F01L 1/344* (2006.01)

(52) U.S. Cl.
CPC ..... *F01L 1/3442* (2013.01); *F01L 2001/34463* (2013.01); *F01L 2001/34466* (2013.01); *F01L 2001/34473* (2013.01)
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS 7,162,984 B2 * 1/2007 Sato et al. ..... 123/90.17
2012/0152190 A1 6/2012 Kobayashi et al.

FOREIGN PATENT DOCUMENTS

WO WO 2011/055589 A1 5/2011

* cited by examiner

*Primary Examiner* — Zelalem Eshete
(74) *Attorney, Agent, or Firm* — Buchanan Ingersoll & Rooney PC

(57) ABSTRACT

A valve timing control apparatus includes a driving-side rotation member, a driven-side rotation member, a first lock mechanism selectively achieving a first lock state in which a relative rotation phase of the driven-side rotation member relative to the driving-side rotation member is locked at an intermediate lock phase and a first lock release state, and a second lock mechanism selectively achieving a second lock state in which the relative rotation phase is locked at one of a most advanced angle phase and a most retarded angle phase and a second lock release state, the driven-side rotation member being rotatable relative to the driving-side rotation member by a first clearance angle in the first lock state, the driven-side rotation member being rotatable relative to the driving-side rotation member by a second clearance angle in the second lock state, the second clearance angle being smaller than the first clearance angle.

3 Claims, 5 Drawing Sheets

VALVE TIMING CONTROL APPARATUS

CROSS REFERENCE TO RELATED APPLICATIONS

This application is based on and claims priority under 35 U.S.C. §119 to Japanese Patent Application 2013-048415, filed on Mar. 11, 2013 and Japanese Patent Application 2014-013518, filed on Jan. 28, 2014, the entire contents of which are incorporated herein by reference.

TECHNICAL FIELD

This disclosure generally relates to a valve timing control apparatus.

BACKGROUND DISCUSSION

A valve timing control apparatus configured to change an opening and closing timing of each of an intake valve and an exhaust valve depending on an operation condition of an internal combustion engine (which will be hereinafter referred to as an engine) has been developed. Such valve timing control apparatus includes, for example, a configuration for changing a relative rotation phase of a driven-side rotation member relative to a driving-side rotation member that rotates by an engine operation so as to change the opening and closing timing of each of the intake valve and the exhaust valve opening and closing in association with the rotation of the driven-side rotation member.

An optimum opening and closing timing of the intake valve and the exhaust valve depends on the operation condition of the engine, for example, depends on whether the engine is started or a vehicle is being driven. At a time of the engine start, the relative rotation phase of the driven-side rotation member relative to the driving-side rotation member is locked at a predetermined phase so as to realize the optimum opening and closing timing of the intake valve and the exhaust valve for the engine start. At this time, however, in a case where the relative rotation phase is maintained at the aforementioned predetermined phase during idling of the engine after the engine start, hydrocarbon emissions (HC emissions) may increase. Thus, during the idling of the engine after the engine start, the relative rotation phase is desired to be changed to a certain phase at which the HC emissions may be restrained.

WO2011/055589A1, which will be hereinafter referred to as Reference 1, discloses a valve timing control apparatus that includes a housing serving as the driving-side rotation member connected to a camshaft, and an inner rotor serving as the driven-side rotation member provided at an inner portion of the housing. According to the valve timing control apparatus disclosed in Reference 1, fluid chambers are formed by the housing and the inner rotor. Each of the fluid chambers is divided into a retarded angle chamber and an advanced angle chamber by a vane serving as a partition portion. The valve timing control apparatus also includes an oil control valve (OCV) for shifting the relative rotation phase of the inner rotor relative to the housing in a retarded angle direction or an advanced angle direction by selecting either the retarded angle chambers or the advanced angle chambers to supply hydraulic oil to the selected chambers. Further, a torsion spring is arranged between the inner rotor and the housing for generating a biasing force so that the relative rotation phase is shifted in the advanced angle direction.

The valve timing control apparatus disclosed in Reference 1 includes two intermediate lock members provided at the housing to be projectable and retractable relative to the inner rotor and single intermediate lock groove formed at the inner rotor so that each of the intermediate lock members is inserted to be fitted to the intermediate lock groove. Each of the intermediate lock members projects to the intermediate lock groove by a biasing force of a spring. An intermediate lock passage is formed at the inner rotor to apply a pressure of hydraulic oil in a direction in which each of the intermediate lock members is retracted from the intermediate lock groove.

A most retarded angle lock member is provided, separately from the intermediate lock members, at the housing. A most retarded angle lock groove is formed, separately from the intermediate lock groove, at the inner rotor so that the most retarded angle lock member is inserted to be fitted to the most retarded angle lock groove. The most retarded angle lock member projects to the most retarded angle lock groove by a biasing force of a spring. A most retarded angle lock passage is formed at the inner rotor to apply a pressure of hydraulic oil in a direction in which the most retarded angle lock member is retracted from the most retarded angle lock groove.

The relative rotation phase of the inner rotor relative to the housing in a case where the intermediate lock members are fitted to the intermediate lock groove is defined as an intermediate lock phase. A state in which the relative rotation phase is arranged at the intermediate lock phase is defined as an intermediate lock state. In addition, the relative rotation phase of the inner rotor relative to the housing in a case where the most retarded angle lock member is fitted to the most retarded angle lock groove is defined as a most retarded angle phase. A state in which the relative rotation phase is arranged at the most retarded angle phase is defined as a most retarded angle lock state.

The valve timing control apparatus disclosed in Reference 1 includes an oil switching valve (OSV) that operates independently from the OCV so as to cause the intermediate lock members to retract from the intermediate lock groove. Because of the OCV and the OSV, the relative rotation phase at the start of the engine is locked at the intermediate lock phase at which startability of the engine is improved. During idling of the engine after the engine start, the relative rotation phase is displaced in the retarded angle direction to be locked at the most retarded angle phase at which hydrocarbon emissions (HC emissions) are restrained.

In the valve timing control apparatus disclosed in Reference 1, in order to obtain smooth projection and retraction of each of the intermediate lock members and the most retarded angle lock member, the inner rotor may rotate relative to the housing by a small angle in the intermediate lock state. Specifically, an angle formed by opposing wall surfaces of the intermediate lock groove in a circumferential direction is slightly greater than an angle formed by respective outer side surfaces of the intermediate lock members in the circumferential direction. A difference between the aforementioned angles will be hereinafter referred to as a first clearance angle. In addition, the inner rotor also rotates relative to the housing by a small angle in the most retarded angle lock state. Specifically, a clearance is formed between a side surface of the most retarded angle lock member at a retarded angle side and a wall surface of the most retarded angle lock groove at the retarded angle side in a state where the vane is in contact with a protruding portion of the housing in the most retarded angle phase. An angle corresponding to the aforementioned clearance will be referred to as a second clearance angle. In the valve timing control apparatus, the first clearance angle and the second clearance angle are basically the same angle.

Because of the first clearance angle and the second clearance angle, however, the inner rotor and the housing move relative to each other by a small amount in the advanced angle direction and the retarded angle direction alternately due to a torque fluctuation of the camshaft, for example, in the intermediate lock state or the most retarded angle lock state. As a result, a hitting sound occurs between the housing and the inner rotor. Such sound is greater in the most retarded angle lock state than in the intermediate lock state because of the following two reasons. First, while a source of hitting sound in the intermediate lock state is mainly a collision between each of the intermediate lock members and the intermediate lock groove, a source of hitting sound in the most retarded angle lock state is a collision between the vane and the protruding portion. At this time, an area at which the vane is collided with the protruding portion is greater than an area at which the intermediate lock members are collided with the intermediate lock groove. Second, in the configuration in which the intermediate lock member projects and retracts in a radial direction relative to a rotation axis as in the valve timing control apparatus disclosed in Reference 1, a portion at which the vane is collided with the protruding portion is closer to an outer side of the valve timing control apparatus than a portion at which each of the intermediate lock members is collided with the intermediate lock groove. Therefore, a collision speed of the vane and the protruding portion is greater than a collision speed of each of the intermediate lock members and the intermediate lock groove, which results in a greater hitting sound. In view of reduction of hitting sound in the most retarded angle lock state, an improved valve timing control apparatus may be desirable.

A need thus exists for a valve timing control apparatus which is not susceptible to the drawback mentioned above.

SUMMARY

According to an aspect of this disclosure, a valve timing control apparatus includes a driving-side rotation member rotating in synchronization with a crankshaft of an internal combustion engine and including an axis, a driven-side rotation member arranged at a radially inner side of the driving-side rotation member and rotating about the axis of the driving-side rotation member in synchronization with a camshaft for opening and closing a valve of the internal combustion engine, a fluid chamber formed between the driving-side rotation member and the driven-side rotation member, a partition portion provided at at least one of the driving-side rotation member and the driven-side rotation member, an advanced angle chamber and a retarded angle chamber formed by divided portions of the fluid chamber divided by the partition portion, first and second stoppers provided at portions which form the advanced angle chamber and the retarded angle chamber respectively, each of the first and second stoppers being configured to make contact with the partition portion by a relative rotation of the driven-side rotation member relative to the driving-side rotation member, a first lock mechanism including a first lock member accommodated at one of the driving-side rotation member and the driven-side rotation member to be projectable and retractable relative to the other of the driving-side rotation member and the driven-side rotation member, the first lock mechanism including a first recess portion formed at the other of the driving-side rotation member and the driven-side rotation member, the first lock member being configured to be fitted to the first recess portion in a projecting state, the first lock mechanism selectively achieving a first lock state and a first lock release state, the first lock state in which a relative rotation phase of the driven-side rotation member relative to the driving-side rotation member is locked at an intermediate lock phase between a most advanced angle phase and a most retarded angle phase by the first lock member projecting to be fitted to the first recess portion, the first lock release state in which a locked state of the relative rotation phase at the intermediate lock phase is released by a retraction of the first lock member from the first recess portion, and a second lock mechanism including a second lock member accommodated at the one of the driving-side rotation member and the driven-side rotation member to be projectable and retractable relative to the other of the driving-side rotation member and the driven-side rotation member, the second lock mechanism including a second recess portion formed at the other of the driving-side rotation member and the driven-side rotation member, the second lock member being configured to be fitted to the second recess portion in a projecting state, the second lock mechanism selectively achieving a second lock state and a second lock release state, the second lock state in which the relative rotation phase is locked at one of the most advanced angle phase and the most retarded angle phase by the second lock member projecting to be fitted to the second recess portion, the second lock release state in which a locked state of the relative rotation phase at the one of the most advanced angle phase and the most retarded angle phase is released by a retraction of the second lock member from the second recess portion, the driven-side rotation member being rotatable relative to the driving-side rotation member by a first clearance angle in the first lock state, the driven-side rotation member being rotatable relative to the driving-side rotation member by a second clearance angle in a case where the partition portion is in contact with one of the first and second stoppers provided at the portions which form the advanced angle chamber and the retarded angle chamber respectively in the second lock state, the second clearance angle being smaller than the first clearance angle.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

A valve timing control apparatus A according to a present embodiment provided at an intake valve side of an engine for a vehicle which will be hereinafter referred to as an engine B will be explained with reference to FIGS. 1 to 5. The engine B serves as an example of an internal combustion engine.

Figure 1:
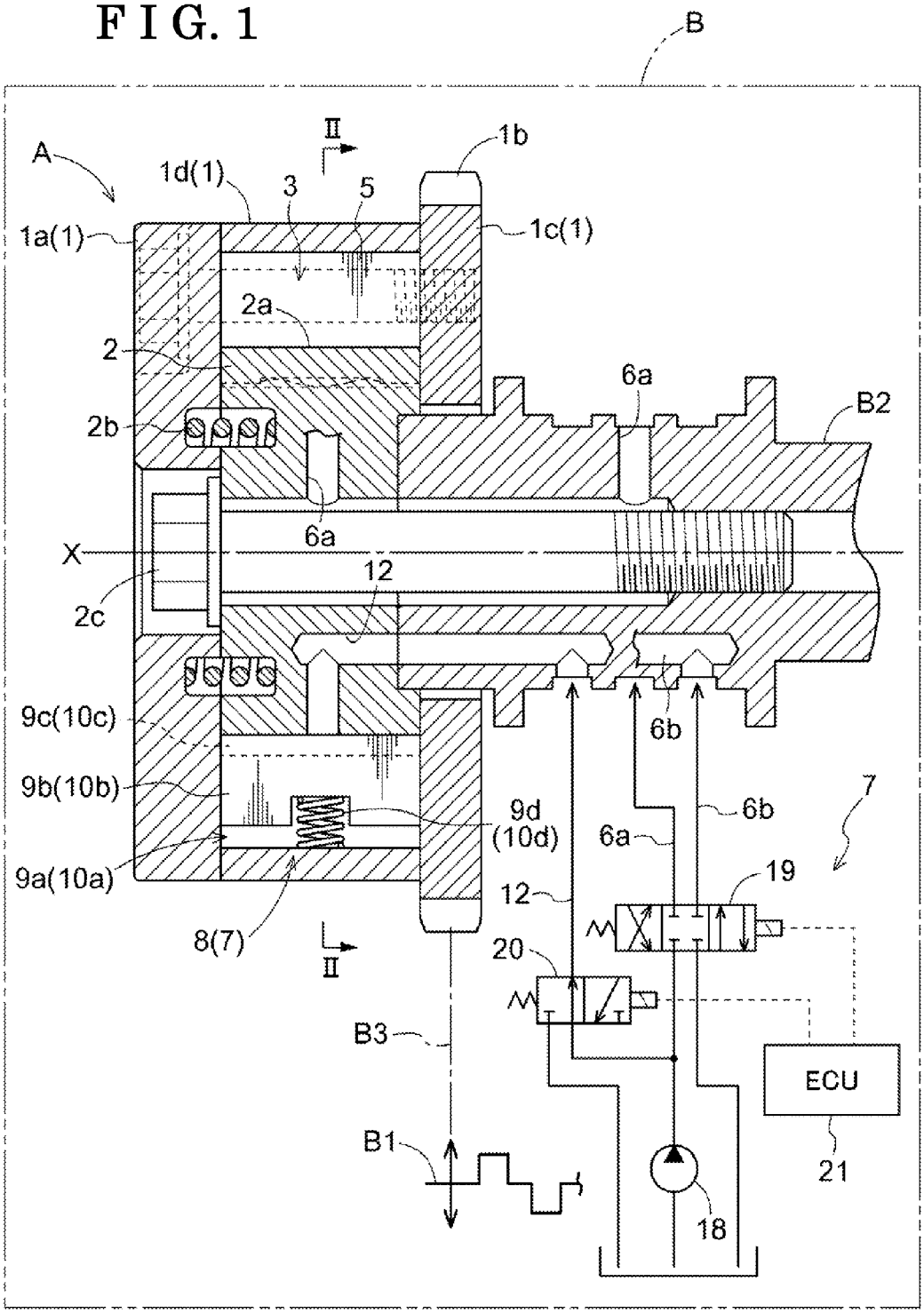
FIG. 1 is a longitudinal section view of a valve timing control apparatus according to an embodiment disclosed here.

As illustrated in FIG. 1, the valve timing control apparatus A includes a housing 1 rotating in synchronization with a crankshaft B1 of the engine B and an inner rotor 2 arranged coaxial with a rotation axis X of the housing 1 so as to be rotatable relative to the housing 1 and rotating in synchronization with a camshaft B2. The inner rotor 2 is arranged at a radially inner side of the housing 1. The housing 1 serves as an example of a driving-side rotation member and the inner rotor 2 serves as an example of a driven-side rotation member. The rotation axis X serves as an example of an axis. The camshaft B2 serves as a rotation shaft of a cam for controlling an opening and closing of an intake valve of the engine B. The camshaft B2 is rotatably assembled on a cylinder head of the engine B.

The valve timing control apparatus A also includes an intermediate lock mechanism 8 configured to lock a relative rotation phase of the inner rotor 2 relative to the housing 1 at an intermediate lock phase serving as a predetermined phase between a most retarded angle phase and a most advanced angle phase. The valve timing control apparatus A further includes a most retarded angle lock mechanism 7 configured to lock the relative rotation phase at the most retarded angle phase positioned at a retarded angle side relative to the intermediate lock phase. The intermediate lock mechanism 8 serves as an example of a first lock mechanism and the most retarded angle lock mechanism 7 serves as an example of a second lock mechanism.

As illustrated in FIG. 1, the inner rotor 2 is integrally assembled on an end portion of the camshaft B2. The inner rotor 2 is fastened and fixed to the end portion of the camshaft B2.

The housing 1 includes a front plate 1*a* provided at an opposite side from a side at which the camshaft B2 is connected, an outer rotor 1*d* mounted at a radially outer side of the inner rotor 2, and a rear plate 1*c* provided at the side at which the camshaft B2 is connected. The rear plate 1*c* integrally includes a timing sprocket 1*b*. The front plate 1*a*, the outer rotor 1*d* and the rear plate 1*c* are fastened to be integrated by a bolt 2*c* in a state where the outer rotor 1*d* is disposed between the front plate 1*a* and the rear plate 1*c* so as to configure the housing 1.

A rotational drive of the crankshaft B1 is transmitted to the timing sprocket 1*b* via a power transmission member B3. The rotation of the timing sprocket 1*b* causes the housing 1 to be driven to rotate in a rotation direction S in FIG. 2. In association with the rotation of the housing 1, the inner rotor 2 rotates in the rotation direction S to thereby rotate the camshaft B2. Then, the cam provided at the camshaft B2 presses down the intake valve of the engine B so that the intake valve is opened.

Figure 2:
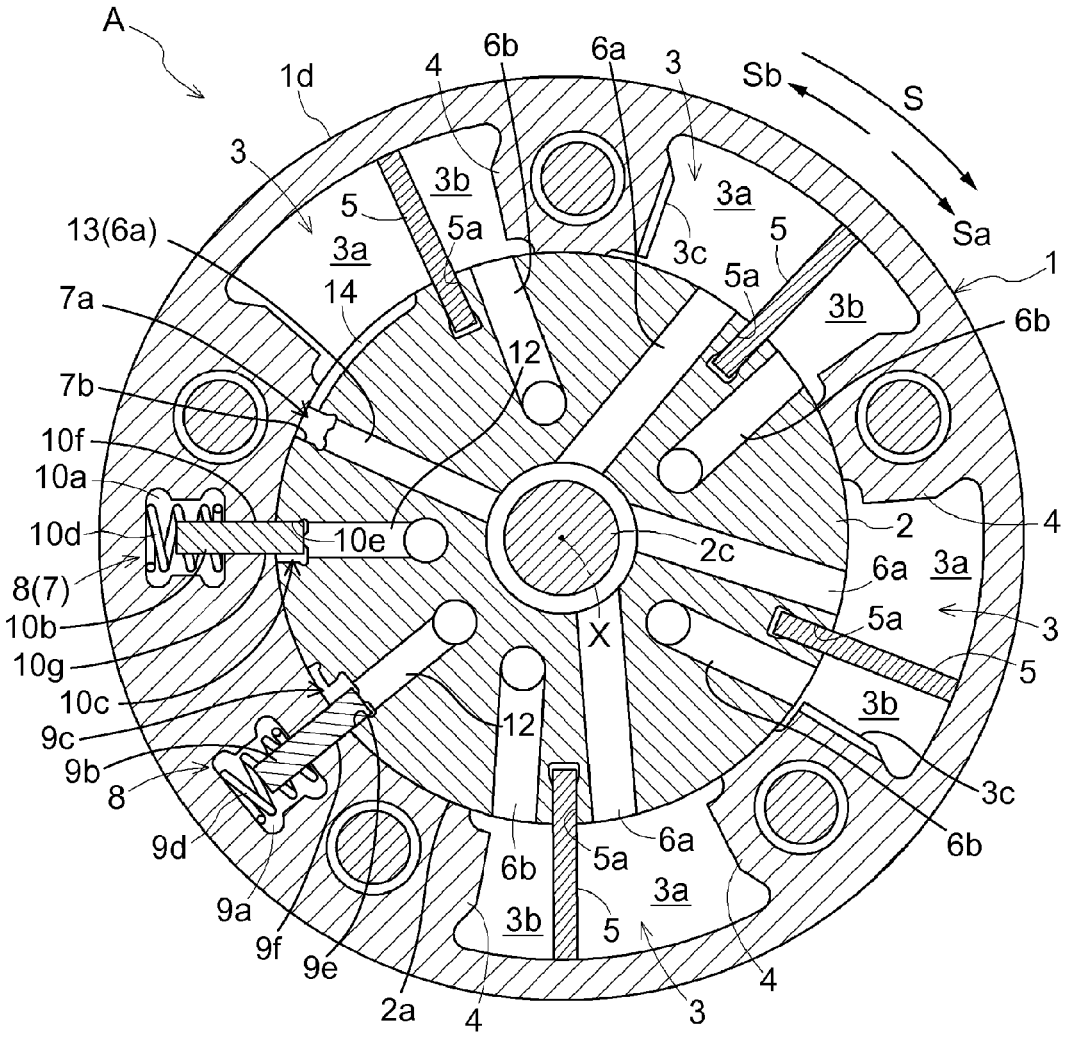
FIG. 2 is a cross-sectional view taken along line II-II in FIG. 1 illustrating an intermediate lock state.

As illustrated in FIG. 2, plural protruding portions 4 are formed to project in a radially inner direction of the outer rotor 1*d* in a state to be away from one another in a circumferential direction. In addition, fluid chambers 3 are formed by and defined between the outer rotor 1*d* and the inner rotor 2. Each of the protruding portions 4 serves as a shoe relative to an outer peripheral surface 2*a* of the inner rotor 2. In the embodiment, four of the fluid chambers 3 are provided. In this case, however, the number of fluid chambers 3 is not limited to four and may be appropriately specified.

Vane grooves 5*a* are formed at portions of the outer peripheral surface 2*a* facing the fluid chambers 3 respectively. Vanes 5 are inserted to the respective vane grooves 5*a* to project radially outwardly. Each of the vanes 5 serves as an example of a partition portion. Each of the fluid chambers 3 is divided into an advanced angle chamber 3*a* and a retarded angle chamber 3*b* by the vane 5. A spring is disposed between the vane groove 5*a* and the vane 5 to bias the vane 5 radially outwardly. Accordingly, leakage of hydraulic oil serving as fluid between the advanced angle chamber 3*a* and the retarded angle chamber 3*b* is inhibited.

As illustrated in FIGS. 1 and 2, advanced angle flow passages 6*a* connected to the respective advanced angle chambers 3*a* are formed at the inner rotor 2 and the camshaft B2 to extend therethrough. Retarded angle flow passages 6*b* connected to the respective retarded angle chambers 3*b* are formed at the inner rotor 2 and the camshaft B2 to extend therethrough. As illustrated in FIG. 2, the advanced angle flow passages 6*a* and the retarded angle flow passages 6*b* are connected to an oil control valve (OCV) 19. The OCV 19 is controlled by an engine control unit (ECU) 21.

The OCV 19 is controlled by the ECU 21 to thereby supply, discharge, or stop supplying and discharging hydraulic oil relative to the advanced angle chambers 3*a* and the retarded angle chambers 3*b* so that an oil pressure of hydraulic oil, i.e., hydraulic oil pressure, is applied to the vanes 5. As a result, the relative rotation phase is displaced in an advanced angle direction or a retarded angle direction, or is held at an appropriate phase. The advanced angle direction corresponds to a direction indicated by an arrow Sa in FIG. 2 (i.e., an advanced angle direction Sa) in which each of the vanes 5 moves by the relative rotation of the inner rotor 2 relative to the housing 1 so as to increase a volume of the advanced angle chamber 3*a*. The retarded angle direction corresponds to a direction indicated by an arrow Sb in FIG. 2 (i.e., a retarded angle direction Sb) in which each of the vanes 5 moves by the relative rotation of the inner rotor 2 so as to increase a volume of the retarded angle chamber 3*b*.

As illustrated in FIG. 1, a torsion spring 2*b* is disposed between the inner rotor 2 and the front plate 1*a*. The torsion spring 2*b* biases the inner rotor 2 in the advanced angle direction Sa against an average displacement force in the retarded angle direction Sb based on a torque fluctuation of the camshaft B2. Accordingly, the relative rotation phase may be smoothly and promptly displaced in the advanced angle direction Sa. In this case, however, the torsion spring 2*b* may bias the inner rotor 2 in the retarded angle direction Sb so that the relative rotation phase is displaced in the retarded angle direction Sb.

According to the aforementioned construction, the inner rotor 2 may smoothly rotate around the rotation axis X relative to the housing 1 within a predetermined range. A range in which the housing 1 and the inner rotor 2 are rotatable relative to each other, i.e., a phase difference between the most retarded angle phase and the most advanced angle phase, corresponds to a range in which each of the vanes 5 is movable within the fluid chamber 3. In the most retarded angle phase, the volume of each of the retarded angle chambers 3*b* is at maximum. In the most advanced angle phase, the volume of each of the advanced angle chambers 3*a* is at maximum.

The intermediate lock mechanism 8 holds the housing 1 and the inner rotor 2 at a predetermined relative position immediately after the start of the engine B or when the engine B is stopped in a state where the hydraulic oil pressure is unstable. The relative rotation phase is therefore locked at the intermediate lock phase between the most retarded angle phase and the most advanced angle phase. Accordingly, the rotation phase of the camshaft B2 relative to the rotation phase of the crankshaft B1 is appropriately maintained to obtain the stable rotation of the engine B. In the present embodiment, the intermediate lock phase is defined to be a phase in which an opening timing of an intake valve and an opening timing of a discharge valve partially overlap each other. As a result, hydrocarbon emissions (HC emissions) may decrease at the start of the engine B, which results in the engine B with a low emission.

The intermediate lock mechanism 8 includes, as illustrated in FIGS. 1 and 2, a first accommodating portion 9*a*, an intermediate lock member 9*b* in a plate form, a first intermediate lock groove 9*c*, a first spring 9*d*, a second accommodating portion 10*a*, a two-way lock member 10*b* in a plate form, a second intermediate lock groove 10*c*, a second spring 10*d*, and intermediate lock release flow passages 12. Each of the intermediate lock member 9*b* and the two-way lock member 10*b* serves as an example of a first lock member. Each of the first intermediate lock groove 9*c* and the second intermediate lock groove 10*c* serves as an example of a first recess portion.

The intermediate lock release flow passages 12 are formed at the inner rotor 2 and the camshaft B2 to extend therethrough so as to connect the first intermediate lock groove 9*c* and the second intermediate lock groove 10*c* to an oil switching valve (OSV) 20. The OSV 20 is controlled so that the supply and discharge of hydraulic oil are selectively performed relative to each of the first intermediate lock groove 9*c* and the second intermediate lock groove 10*c*. The first intermediate lock groove 9*c* includes a ratchet mechanism including a wide groove opening towards the outer peripheral surface 2*a* of the inner rotor 2 and a narrow groove opening towards a bottom surface of the wide groove. A side surface of the wide groove and a side surface of the narrow groove in the retarded angle direction Sb are coplanar with each other to form a side wall 9*e*. The second intermediate lock groove 10*c* includes a single depth.

The first accommodating portion 9*a* and the second accommodating portion 10*a* are formed at the outer rotor 1*d*. The intermediate lock member 9*b* is accommodated at the first accommodating portion 9*a* to be projectable and retractable relative to the first accommodating portion 9*a* in the radial direction. The first spring 9*d* is arranged at the first accommodating portion 9*a* to bias the intermediate lock member 9*b* radially inwardly, i.e., bias the intermediate lock member 9*b* towards the first intermediate lock groove 9*c*. The two-way lock member 10*b* is accommodated at the second accommodating portion 10*a* to be projectable and retractable relative to the second accommodating portion 10*a* in the radial direction. The second spring 10*d* is arranged at the second accommodating portion 10*a* to bias the two-way lock member 10*b* radially inwardly, i.e., bias the two-way lock member 10*b* towards the second intermediate lock groove 10*c*.

In a case where the intermediate lock member 9*b* and the first intermediate lock groove 9*c* face each other and the two-way lock member 10*b* and the second intermediate lock groove 10*c* face each other in a state where the hydraulic oil is discharged from the first intermediate lock groove 9*c* and the second intermediate lock groove 10*c*, the intermediate lock member 9*b* and the two-way lock member 10*b* project towards the first intermediate lock groove 9*c* and the second intermediate lock groove 10*c* respectively. As illustrated in FIG. 2, in a case where the intermediate lock member 9*b* projects to be positioned within the first intermediate lock groove 9*c*, the side wall 9*e* and a retarded angle-side plate surface 9*f* of the intermediate lock member 9*b* make contact with each other to restrict the relative rotation of the inner rotor 2 relative to the housing 1 in the advanced angle direction Sa. At the same time, a side wall 10*e* serving as a wall surface of the second intermediate lock groove 10*c* at the advanced angle side and an advanced angle-side plate surface 10*f* of the two-way lock member 10*b* make contact with each other to restrict the relative rotation of the inner rotor 2 in the retarded angle direction Sb. As a result, the relative rotation of the inner rotor 2 relative to the housing 1 is restricted so that the relative rotation phase is locked at the intermediate lock phase.

In a case where the ECU 21 controls the OSV 20 to operate so that the hydraulic oil is supplied to the first intermediate lock groove 9*c* and the second intermediate lock groove 10*c*, the intermediate lock member 9*b* is retracted from the first intermediate lock groove 9*c* against the biasing force of the first spring 9*d* because of the pressure of hydraulic oil. At the same time, the two-way lock member 10*b* is retracted from the second intermediate lock groove 10*c* against the biasing force of the second spring 10*d* because of the pressure of hydraulic oil. As a result, the locked state of the relative rotation phase is released and therefore the inner rotor 2 is allowed to rotate relative to the housing 1. Hereinafter, a state where the relative rotation phase is locked at the intermediate lock phase by the intermediate lock mechanism 8 will be referred to as an intermediate lock state, and a state where the intermediate lock state is released will be referred to as an intermediate lock release state. The intermediate lock state serves as an example of a first lock state and the intermediate lock release state serves as an example of a first lock release state.

Figure 4:
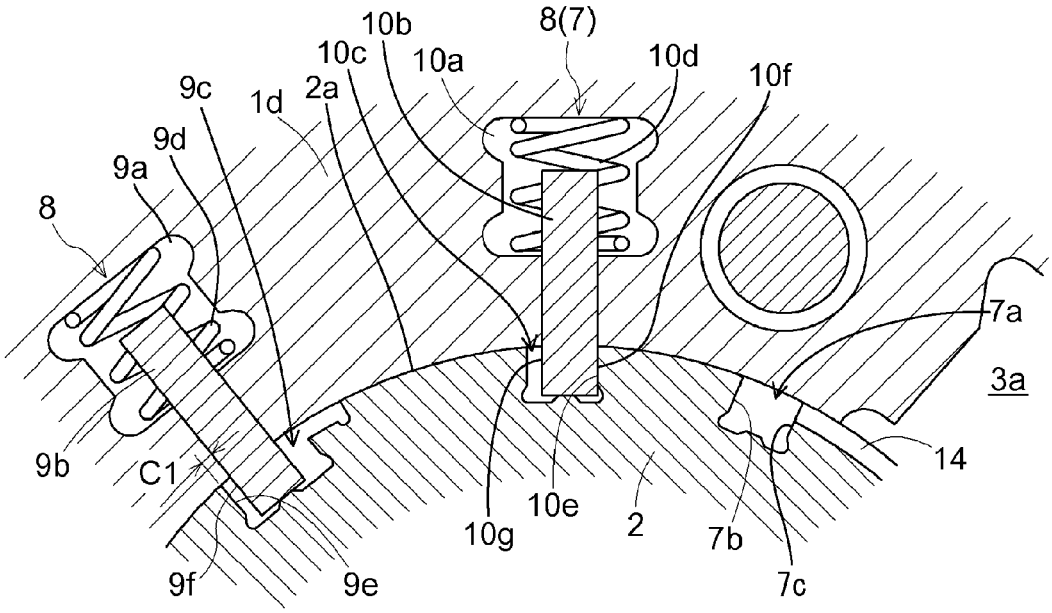
FIG. 4 is an enlarged cross-sectional view illustrating a first clearance angle in the intermediate lock state.

In the intermediate lock state according to the present embodiment, as mentioned above, the relative rotation phase is locked at the intermediate lock phase. Nevertheless, the inner rotor 2 is practically rotatable relative to the housing 1 by a small angle. Specifically, as illustrated in FIG. 4, a clearance is formed between the retarded angle-side plate surface 9*f* and the side wall 9*e* when the advanced angle-side plate surface 10*f* and the side wall 10*e* make contact with each other in the intermediate lock state. The inner rotor 2 is allowed to rotate relative to the housing 1 by the aforementioned clearance. An angle formed between the retarded angle-side plate surface 9*f* and the side wall 9*e* relative to the rotation axis X will be hereinafter referred to as a first clearance angle C1. Because of the clearance, the intermediate lock member 9*b* and the two-way lock member 10*b* are smoothly and promptly projectable and retractable relative to the first intermediate lock groove 9*c* and the second intermediate lock groove 10*c* respectively.

Instead of the plate form as in the present embodiment, the form of each of the intermediate lock member 9*b* and the two-way lock member 10*b* may be appropriately specified. For example, each of the intermediate lock member 9*b* and the two-way lock member 10*b* may include a pin form. In such case, a clearance may also be formed between the intermediate lock member 9*b* and the first intermediate lock groove 9*c*, and between the two-way lock member 10*b* and the second intermediate lock groove 10*c* in the intermediate lock state.

The most retarded angle lock mechanism 7 locks the relative rotation of the inner rotor 2 relative to the housing 1 at a predetermined relative rotation phase, i.e., at the most retarded angle phase, at a time of a low speed rotation of the engine, for example, at idling operation, idling stop, and idling restart. At this time, regardless of generation of displacement force in the retarded angle direction Sb and the advanced angle direction Sa based on the torque fluctuation of the camshaft B2, the inner rotor 2 is inhibited from rotating relative to the housing 1. Thus, a stable idling operation is achievable. In the present embodiment, the most retarded angle phase is defined to be a phase in which a closing timing of the discharge valve and an opening timing of the intake valve are substantially the same and thus the idling operation is stabilized. The engine B may start even when the relative rotation phase is arranged at the most retarded angle phase.

As illustrated in FIGS. 1 and 2, the most retarded angle lock mechanism 7 includes a most retarded angle lock groove 7*a*, the second accommodating portion 10*a*, the two-way lock member 10*b*, the second spring 10*d*, and a most retarded angle lock release flow passage 13. The most retarded angle lock groove 7*a* serves as an example of a second recess portion. The two-way lock member 10*b* serves as an example of a second lock member. That is, the two-way lock member 10*b* includes both functions as the first lock member and the second lock member. Because of the aforementioned configuration of the two-way lock member 10*b*, the intermediate lock state and a most retarded angle lock state which will be explained later may be achieved by the reduced number of lock members.

The most retarded angle lock release flow passage 13 also serves as one of the advanced angle flow passages 6*a*. The most retarded angle lock release flow passage 13 connects between the most retarded angle lock groove 7*a* and the OCV 19. In addition, a connection flow passage 14 is formed at the outer peripheral surface 2*a* of the inner rotor 2 to extend in the circumferential direction from the most retarded angle lock groove 7*a* towards the vane groove 5*a* arranged nearest to the most retarded angle lock groove 7*a* in the advanced angle direction Sa. Thus, in a case where the OSV 20 is operated to supply or discharge the hydraulic oil relative to the advanced angle chambers 3*a*, the hydraulic oil is also supplied or discharged relative to the most retarded angle lock groove 7*a*.

Figure 3:
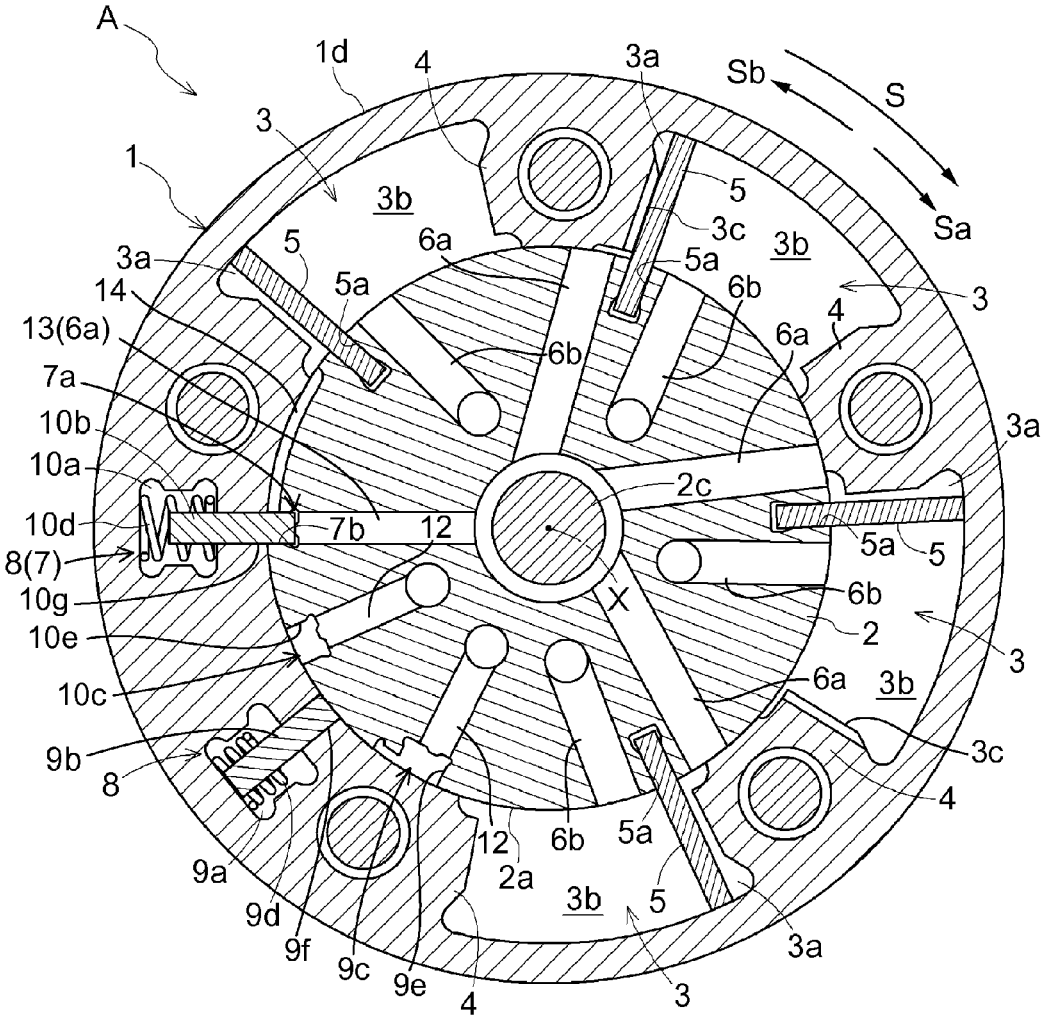
FIG. 3 is a cross-sectional view taken along line II-II in FIG. 1 illustrating a most retarded angle lock state.

In a case where the inner rotor 2 rotates relative to the housing 1 in the retarded angle direction Sb so that the vane 5 makes contact with a stopper 3*c* provided at one of the advanced angle chambers 3*a* (i.e., a first stopper) in a state where the hydraulic oil is discharged from the most retarded angle lock groove 7*a* in the intermediate lock release state, the two-way lock member 10*b* faces the most retarded angle lock groove 7*a* to project thereto. When the two-way lock member 10*b* projects to be positioned within the most retarded angle lock groove 7*a*, as illustrated in FIG. 3, a side wall 7*b* serving as a wall surface of the most retarded angle lock groove 7*a* at the retarded angle side and a retarded angle-side plate surface 10*g* of the two-way lock member 10*b* make contact with each other to thereby restrict the inner rotor 2 from rotating in the advanced angle direction Sa relative to the housing 1. In addition, the inner rotor 2 is inhibited from rotating relative to the housing 1 in the retarded angle direction Sb. As a result, the relative rotation of the inner rotor 2 relative to the housing 1 is restricted so that the relative rotation phase is locked at the most retarded angle phase. The stopper 3*c* may be also provided at one of the retarded angle chambers 3*b* (i.e., a second stopper).

In a case where the OCV 19 is controlled by the ECU 21 so that the relative rotation phase is displaced in the advanced angle direction Sa, the hydraulic oil is supplied to the most retarded angle lock groove 7*a* by flowing through the most retarded angle lock release flow passage 13. Then, the two-way lock member 10*b* is retracted from the most retarded angle lock groove 7*a* against the biasing force of the second spring 10*d*. Accordingly, the locked state of the relative rotation phase at the most retarded angle phase is released to allow the inner rotor 2 to move in the advanced angle direction Sa. Hereinafter, a state where the relative rotation phase is locked at the most retarded angle phase by the most retarded angle lock mechanism 7 will be referred to as the most retarded angle lock state, and a state where the most retarded angle lock state is released will be referred to as a most retarded angle lock release state. The most retarded angle lock state serves as an example of a second lock state and the most retarded angle lock release state serves as an example of a second lock release state. In the second lock state, the relative rotation phase may be locked at the most advanced angle phase.

Figure 5:
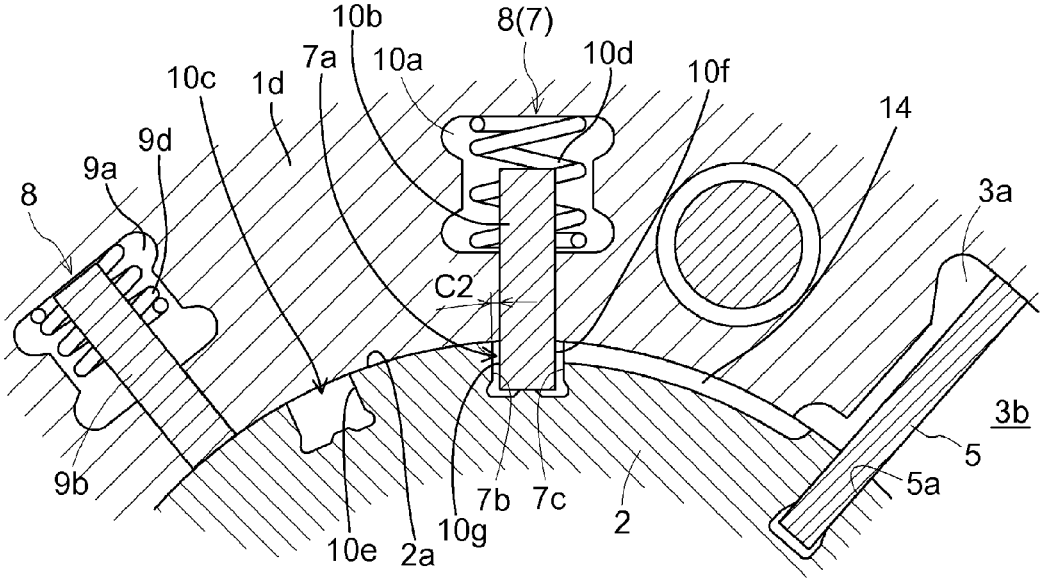
FIG. 5 is an enlarged cross-sectional view illustrating a second clearance angle in the most retarded angle lock state.

In the most retarded angle lock state according to the present embodiment, as mentioned above, the relative rotation phase is locked at the most retarded angle phase. Nevertheless, the inner rotor 2 is practically rotatable relative to the housing 1 by a small angle. Specifically, as illustrated in FIG. 5, a clearance is formed between the retarded angle-side plate surface 10*g* and the side wall 7*b* when the vane 5 and the stopper 3*c* make contact with each other in the most retarded angle lock state. The inner rotor 2 is allowed to rotate in the advanced angle direction Sa relative to the housing 1 by the aforementioned clearance. An angle formed between the retarded angle-side plate surface 10*g* and the side wall 7*b* relative to the rotation axis X will be hereinafter referred to as a second clearance angle C2. At this time, a clearance is also formed between the advanced angle-side plate surface 10*f* and a side wall 7*c* serving as a wall surface of the most retarded angle lock groove 7*a* at the advanced angle side. Because of the aforementioned clearances formed between the two-way lock member 10*b* and the most retarded angle lock groove 7*a*, the two-way lock member 10*b* is smoothly and promptly projectable and retractable relative to the most retarded angle lock groove 7*a*. Normally, the first clearance angle C1 and the second clearance angle C2 are configured to be the same angle. In the valve timing control apparatus A of the present embodiment, however, the second clearance angle C2 is configured to be smaller than the first clearance angle C1.

In a state where the relative rotation phase is arranged at a phase other than the most retarded angle phase, the two-way lock member 10*b* is inhibited from facing the most retarded angle lock groove 7*a*. The most retarded angle lock release flow passage 13 and the advanced angle chamber 3*a* are constantly connected to each other via the connection flow passage 14.

Instead of the plate form as in the present embodiment, the form of the two-way lock member 10*b* may be appropriately specified. For example, the two-way lock member 10*b* may include a pin form. In such case, a clearance may also be formed between the two-way lock member 10*b* and the most retarded angle lock groove 7*a* in the most retarded angle lock state. In addition, the connection flow passage 14 may not be formed in a groove. That is, a corner portion of the outer periphery of the inner rotor 2 may be chamfered.

Next, a hydraulic oil supply and discharge mechanism will be explained. As illustrated in FIG. 1, the hydraulic oil supply and discharge mechanism includes a mechanical oil pump 18 driven by the engine B to supply the hydraulic oil, the spool type OCV 19 controlling the supply and discharge of hydraulic oil relative to the advanced angle flow passages 6*a* and the retarded angle flow passages 6*b*, and the spool type OSV 20 serving as a switching mechanism for switching between supplying the hydraulic oil and discharging the hydraulic oil relative to the intermediate lock release flow passages 12. The ECU 21 controls the operations of the oil pump 18, the OCV 19, and the OSV 20.

The ECU 21 controls an amount of electric power supplied to the OCV 19 so that a position of a spool valve thereof is changed to thereby perform an advanced angle control, a retarded angle control, and a shutoff control. In the advanced angle control, the hydraulic oil is supplied to the advanced angle chambers 3*a* and is discharged from the retarded angle chambers 3*b*. In the retarded angle control, the hydraulic oil is supplied to the retarded angle chambers 3*b* and is discharged from the advanced angle chambers 3*a*. In the shutoff control, the supply and discharge of hydraulic oil relative to the advanced angle chambers 3*a* and the retarded angle chambers 3*b* is interrupted or blocked.

In the present embodiment, a hydraulic oil passage allowing the advanced angle control is formed in a case where the amount of power supply to the OCV 19 is at maximum. In this case, the hydraulic oil is supplied from the advanced angle flow passages 6*a* so that the volume of each of the advanced angle chambers 3*a* increases to displace or move the relative rotation phase of the inner rotor 2 relative to the housing 1 in the advanced angle direction Sa. At this time, the hydraulic oil is also supplied to the most retarded angle lock release flow passage 13 so that the most retarded angle lock mechanism 7 is in the most retarded angle lock release state. In a case where the power supply to the OCV 19 is shut off, a hydraulic oil passage allowing the retarded angle control is formed. The hydraulic oil is supplied from the retarded angle flow passages 6*b* so that the volume of each of the retarded angle chambers 3*b* increases to displace or move the relative rotation phase of the inner rotor 2 relative to the housing 1 in the retarded angle direction Sb. In a case where a duty ratio of power supply is 50%, the supply and discharge of hydraulic oil relative to both the advanced angle chambers 3*a* and the retarded angle chambers 3*b* are shut off so that the relative rotation phase is held and maintained at any appropriate phase.

A position of a spool valve of the OSV 20 is changed by the ECU 21 that controls an amount of electric power supply to the OSV 20 so that the supply of hydraulic oil to the first intermediate lock groove 9*c* and the discharge of hydraulic oil from the first intermediate lock groove 9*c* are selectively performed. In the embodiment, the OSV 20 is brought to a state in which the hydraulic oil may be discharged from the first intermediate lock groove 9*c* when the OSV 20 is supplied with the maximum electric power and is brought to a state in which the hydraulic oil may be supplied to the first intermediate lock groove 9*c* when the power supply to the OSV 20 is shutoff.

In the embodiment, a crank angle sensor is provided to detect a rotation angle of the crankshaft B1 of the engine B. In addition, a camshaft angle sensor is provided to detect a rotation angle of the camshaft B2. The ECU 21 detects and identifies the relative rotation phase based on detection results of the crank angle sensor and the camshaft angle sensor. Further, the ECU 21 forms a signal system acquiring information of an on and off state of an ignition key and information from an oil temperature sensor that detects the oil temperature of hydraulic oil, for example. The ECU 21 stores, in a memory thereof, control information of the most appropriate relative rotation phase of the inner rotor 2 relative to the housing 1 depending on the operation condition of the engine B. The ECU 21 controls the relative rotation phase based on the operation condition of the vehicle, for example, engine speed and cooling water temperature, and the aforementioned control information.

The operation of the valve timing control apparatus A will be explained. Before the start of the engine B, the intermediate lock state is obtained by the intermediate lock mechanism 8. In a case where the ignition key is turned on, the engine B is started in a state where the relative rotation phase is locked at the intermediate lock phase as illustrated in FIG. 2, i.e., in the intermediate lock state, so as to start the idling operation (i.e., before a catalyst warm-up). At the same time the ignition key is turned on, the electric power is supplied to the OSV 20 to maintain the intermediate lock state. At this time, the inner rotor 2 and the housing 1 unstably move relative to each other by a small amount. Specifically, the relative rotation of the inner rotor 2 relative to the housing 1 alternately occurs in the advanced angle direction Sa and the retarded angle direction Sb within the range of the first clearance angle C1 as illustrated in FIG. 4. Accordingly, a collision between the retarded angle-side plate surface 9*f* and the side wall 9*e* and a collision between the advanced angle-side plate surface 10*f* and the side wall 10*e* alternately occur, which results in generation of hitting sound.

When the catalyst warm-up is completed, the OCV 19 is supplied with the power to perform the retarded angle control so as to move the relative rotation phase to the most retarded angle phase suitable for the idling operation. In addition, the power supply to the OSV 20 is stopped so as to supply the hydraulic oil to the first intermediate lock groove 9*c*. Because of the oil pressure of hydraulic oil, the intermediate lock member 9*b* and the two-way lock member 10*b* are retracted from the first intermediate lock groove 9*c* and the second intermediate lock groove 10*c* respectively to obtain the intermediate lock release state. On the other hand, the hydraulic oil in the most retarded angle lock groove 7*a* is discharged, together with the hydraulic oil within the advanced angle chamber 3*a*, by flowing through the most retarded angle lock release flow passage 13. As a result, the relative rotation phase is displaced in the retarded angle direction Sb.

In a case where the relative rotation phase reaches the most retarded angle phase suitable for the idling operation and the two-way lock member 10*b* faces the most retarded angle lock groove 7*a*, the two-way lock member 10*b* projects to be positioned within the most retarded angle lock groove 7*a* as illustrated in FIG. 3 to obtain the most retarded angle lock state. At this time, the inner rotor 2 and the housing 1 unstably move relative to each other by a small amount. Specifically, the relative rotation of the inner rotor 2 relative to the housing 1 alternately occurs in the advanced angle direction Sa and the retarded angle direction Sb within the range of the second clearance angle C2 as illustrated in FIG. 5. Accordingly, a collision between the retarded angle-side plate surface 10*g* and the side wall 7*b* and a collision between the vane 5 and the stopper 3*c* alternately occur, which results in generation of hitting sound.

In a case of a known valve timing control apparatus in which the first clearance angle Cl and the second clearance angle C2 are configured to be substantially the same angle, an area at which the vane 5 and the stopper 3*c* are collided with each other is greater than an area at which the retarded angle-side plate surface 9*f* and the side wall 9*e* are collided with each other and an area at which the advanced angle-side plate surface 10*f* and the side wall 10*e* are collided with each other. Thus, the hitting sound generated in the most retarded angle lock state is greater than the hitting sound generated in the intermediate lock state, which is unpleasant for a user of the vehicle. On the other hand, according to the valve timing control apparatus A of the embodiment, the second clearance angle C2 is configured to be smaller than the first clearance angle C1. Thus, the speed of collision between the vane 5 and the stopper 3*c* is reduced, which may decrease the unpleasant hitting sound.

Thereafter, in a state of a normal driving condition, the advanced angle control and the retarded angle control are appropriately performed depending on the load and the rotation speed of the engine B, for example, to move the relative rotation phase to the advanced angle side or the retarded angle side, or to maintain the relative rotation phase at an appropriate phase by the power supply to the OCV 19 with the duty ratio of 50%. Each time the relative rotation phase reaches the most retarded angle phase, the most retarded angle lock state is established. Nevertheless, the most retarded angle lock release state may be immediately obtained by performing the advanced angle control, which may result in no inconvenience.

In the present embodiment, the relative rotation phase is locked at the most retarded angle phase. Alternatively, the relative rotation phase may be locked at the most advanced angle phase. Further alternatively, the relative rotation phase may be locked at both the most retarded angle phase and the most advanced angle phase. In a state where the vane 5 and the stopper 3*c* are in contact with each other in the locked state at the most advanced angle phase, the clearance including the second clearance angle C2 is formed between the two-way lock member 10*b* fitted to the most retarded angle lock groove 7*a* and the most retarded angle lock groove 7*a*. The inner rotor 2 is movable relative to the housing 1 by the aforementioned clearance.

In the present embodiment, the most retarded angle lock release flow passage 13 serving as one of the advanced angle flow passages 6*a* is connected to the connection flow passage 14. Alternatively, the most retarded angle lock release flow passage 13 is formed independently from the advanced angle flow passage 6*a*. In this case, the connection flow passage 14 is not necessarily formed. Even in this case, the most retarded angle lock release flow passage 13 is connected to the OCV 19 so that the hydraulic oil is supplied and discharged relative to the most retarded angle lock release flow passage 13 in association with the supply and discharge of hydraulic oil to the advanced angle flow passages 6*a*.

In the present embodiment, the two-way lock member 10*b* constitutes a portion of the intermediate lock mechanism 8 and a portion of the most retarded angle lock mechanism 7. Alternatively, each of the intermediate lock mechanism 8 and the most retarded angle lock mechanism 7 may include an independent and exclusive lock member.

In the present embodiment, the power supply to the OCV 19 allows the retarded angle control and the stop of the power supply to the OCV 19 allows the advanced angle control. Alternatively, the power supply to the OCV 19 may allow the advanced angle control and the stop of the power supply to the OCV 19 may allow the retarded angle control.

In the present embodiment, the power supply to the OSV 20 allows the discharge of hydraulic oil from the first intermediate lock groove 9*c* and the stop of power supply to the OSV 20 allows the supply of hydraulic oil to the first intermediate lock groove 9*c*. Alternatively, the power supply to the OSV 20 may allow the supply of hydraulic oil to the first intermediate lock groove 9*c* and the stop of power supply to the first intermediate lock groove 9*c* may allow the discharge of hydraulic oil from the first intermediate lock groove 9*c*.

The embodiment is applicable to a valve timing control apparatus controlling a relative rotation phase of a driven-side rotation member relative to a driving-side rotation member that rotates in synchronization with a crankshaft of an internal combustion engine.

According to the aforementioned embodiment, the intermediate lock state (the first lock state) in the intermediate lock phase is achieved by the restriction of the relative rotation of the housing 1 and the inner rotor 2 in opposing directions by the fitting between the intermediate lock member 9*b* and the first intermediate lock groove 9*c* and the fitting between the two-way lock member 10*b* and the second intermediate lock groove 10*c*. On the other hand, the most retarded angle lock state (the second lock state) in the most retarded angle phase (or the most retarded angle phase) is achieved by the restriction of the relative rotation by the fitting between the two-way lock member 10*b* and the most retarded angle lock groove 7*a*. Therefore, in a case where the housing 1 and the inner rotor 2 move relative to each other by a small amount in the advanced angle direction and the retarded angle direction alternately in the intermediate lock phase because of the torque fluctuation of the camshaft B2, for example, a collision mainly between the intermediate lock member 9*b* and the first intermediate lock groove 9*c* and between the two-way lock member 10*b* and the second intermediate lock groove 10*c* continuously occurs within a range of the first clearance angle C1 so that the hitting sound is generated. In addition, in a case where the housing 1 and the inner rotor 2 move relative to each other by a small amount in the advanced angle direction and the retarded angle direction alternately in the most retarded angle lock state because of the torque fluctuation of the camshaft B2, for example, a collision between the two-way lock member 10*b* and the most retarded angle lock groove 7*a* and a collision between the vane 5 and the fluid chamber 3 (the stopper 3*c*) continuously occur within a range of the second clearance angle C2 so that the hitting sound is generated. Generally, an area at which the vane 5 and the stopper 3*c* are collided with each other is greater than an area at which the intermediate lock member 9*b* and the first intermediate lock groove 9*c* are collided each other and the two-way lock member 10*b* and the second intermediate lock groove 10*c* are collided with each other. The area at which the vane 5 and the stopper 3*c* are collided with each other is also greater than an area at which the two-way lock member 10*b* and the most retarded angle lock groove 7*a* are collided with each other. Thus, in the most retarded angle lock state, the hitting sound generated by the collision between the vane 5 and the stopper 3*c* is dominant, i.e., greater than the hitting sound generated by the collision between the two-way lock member 10*b* and the most retarded angle lock groove 7*a*. In addition, the hitting sound generated by the collision between the intermediate lock member 9*b* and the first intermediate lock groove 9*c* and between the two-way lock member 10*b* and the second intermediate lock groove 10*c* in the intermediate lock phase is substantially the same level as the hitting sound generated by the collision between the two-way lock member 10*b* and the most retarded angle lock groove 7*a* in the most retarded angle lock state. Therefore, in a case where the first clearance angle C1 and the second clearance angle C2 are substantially the same angle, the hitting sound generated by the collision between the vane 5 and the stopper 3*c* in the most retarded angle lock state is greater than the hitting sound generated by the collision between the intermediate lock member 9*b* and the first intermediate lock groove 9*c* and between the two-way lock member 10*b* and the second intermediate lock groove 10*c* in the intermediate lock phase. Nevertheless, according to the embodiment, the second clearance angle C2 is smaller than the first clearance angle C1 so that, even though a collision area between the vane 5 and the stopper 3*c* is large, a collision speed between the vane 5 and the stopper 3*c* is reduced. The generation of hitting sound in the most retarded angle lock state may be reduced accordingly.

In addition, according to the embodiment, the intermediate lock member 9*b* and the two-way lock member 10*b* are both accommodated at the housing 1, and the intermediate lock member 9*b* and the two-way lock member 10*b* are projectable and retractable relative to the rotation axis X of the housing 1 in the radial direction.

In the configuration in which the intermediate lock member 9*b* and the two-way lock member 10*b* project and retract in the radial direction relative to the rotation axis X, a portion at which the vane 5 is collided with the stopper 3*c* is closer to the outer side of the valve timing control apparatus A than a portion at which the intermediate lock member 9*b* and the first intermediate lock groove 9*c* are collided each other, and a portion at which the two-way lock member 10*b* and the second intermediate lock groove 10*c* are collided with each other. Therefore, in a case where the first clearance angle C1 and the second clearance angle C2 are substantially the same, in view of the hitting sound at the outer side of the valve timing control apparatus A, the hitting sound generated by the collision between the vane 5 and the stopper 3*c* in the most retarded angle lock state is greater than the hitting sound generated by the collision between the intermediate lock member 9*b* and the first intermediate lock groove 9*c* and between the two-way lock member 10*b* and the second intermediate lock groove 10*c*. According to the embodiment, because the second clearance angle C2 is smaller than the first clearance angle C1, the hitting sound at the outer side of the valve timing control apparatus A in the most retarded angle lock state may be greatly reduced.

Further, in the embodiment, the two-way lock member 10*b* also includes the function as the first lock member.

Accordingly, the intermediate lock state (the first lock state) and the most retarded angle lock state (the second lock state) may be achieved by the reduced number of lock members.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve timing control apparatus comprising:

a driving-side rotation member rotating in synchronization with a crankshaft of an internal combustion engine and including an axis;

a driven-side rotation member arranged at a radially inner side of the driving-side rotation member and rotating about the axis of the driving-side rotation member in synchronization with a camshaft for opening and closing a valve of the internal combustion engine;

a fluid chamber formed between the driving-side rotation member and the driven-side rotation member;

a partition portion provided at at least one of the driving-side rotation member and the driven-side rotation member;

an advanced angle chamber and a retarded angle chamber formed by divided portions of the fluid chamber divided by the partition portion;

first and second stoppers provided at portions which form the advanced angle chamber and the retarded angle chamber respectively, each of the first and second stoppers being configured to make contact with the partition portion by a relative rotation of the driven-side rotation member relative to the driving-side rotation member;

a first lock mechanism including a first lock member accommodated at one of the driving-side rotation member and the driven-side rotation member to be projectable and retractable relative to the other of the driving-side rotation member and the driven-side rotation member, the first lock mechanism including a first recess portion formed at the other of the driving-side rotation member and the driven-side rotation member, the first lock member being configured to be fitted to the first recess portion in a projecting state;

the first lock mechanism selectively achieving a first lock state and a first lock release state, the first lock state in which a relative rotation phase of the driven-side rotation member relative to the driving-side rotation member is locked at an intermediate lock phase between a most advanced angle phase and a most retarded angle phase by the first lock member projecting to be fitted to the first recess portion, the first lock release state in which a locked state of the relative rotation phase at the intermediate lock phase is released by a retraction of the first lock member from the first recess portion, and a second lock mechanism including a second lock member accommodated at the one of the driving-side rotation member and the driven-side rotation member to be projectable and retractable relative to the other of the driving-side rotation member and the driven-side rotation member, the second lock mechanism including a second recess portion formed at the other of the driving-side rotation member and the driven-side rotation member, the second lock member being configured to be fitted to the second recess portion in a projecting state;

the second lock mechanism selectively achieving a second lock state and a second lock release state, the second lock state in which the relative rotation phase is locked at one of the most advanced angle phase and the most retarded angle phase by the second lock member projecting to be fitted to the second recess portion, the second lock release state in which a locked state of the relative rotation phase at the one of the most advanced angle phase and the most retarded angle phase is released by a retraction of the second lock member from the second recess portion, the driven-side rotation member being rotatable relative to the driving-side rotation member by a first clearance angle in the first lock state, the driven-side rotation member being rotatable relative to the driving-side rotation member by a second clearance angle in a case where the partition portion is in contact with one of the first and second stoppers provided at the portions which form the advanced angle chamber and the retarded angle chamber respectively in the second lock state, the second clearance angle being smaller than the first clearance angle.

2. The valve timing control apparatus according to claim 1, wherein the first lock member and the second lock member are both accommodated at the driving-side rotation member, and the first lock member and the second lock member are projectable and retractable relative to the axis of the driving-side rotation member in a radial direction.

3. The valve timing control apparatus according to claim 1, wherein the second lock member also includes a function as the first lock member.

* * * * *